US010175643B1

(12) United States Patent
Carpenter et al.

(10) Patent No.: US 10,175,643 B1
(45) Date of Patent: Jan. 8, 2019

(54) IMAGING UNIT HAVING POSITIONAL CONTROL FEATURES FOR USE IN AN ELECTROPHOTOGRAPHIC IMAGE FORMING DEVICE

(71) Applicant: LEXMARK INTERNATIONAL, INC., Lexington, KY (US)

(72) Inventors: Brian Scott Carpenter, Lexington, KY (US); Jason Paul Hale, Pembroke Pines, FL (US); James Richard Leemhuis, Lexington, KY (US); Matthew Lee Rogers, Lexington, KY (US); Daniel Joshua Smith, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/722,075

(22) Filed: Oct. 2, 2017

Related U.S. Application Data

(60) Provisional application No. 62/520,118, filed on Jun. 15, 2017.

(51) Int. Cl.
*G03G 21/18* (2006.01)
*G03G 15/08* (2006.01)

(52) U.S. Cl.
CPC ..... *G03G 21/1821* (2013.01); *G03G 15/0896* (2013.01); *G03G 21/1842* (2013.01); *G03G 21/1867* (2013.01); *G03G 2221/1853* (2013.01); *G03G 2221/1861* (2013.01)

(58) Field of Classification Search
CPC ..... G03G 21/1821; G03G 21/1842; G03G 21/1867; G03G 15/0896; G03G 2221/1853; G03G 2221/1861; G03G 2221/1654
See application file for complete search history.

(56) References Cited

U.S. PATENT DOCUMENTS

| | | | |
|---|---|---|---|
| 5,768,661 | A | 6/1998 | Coffey et al. |
| 7,139,510 | B2 | 11/2006 | Carter et al. |
| 7,831,168 | B2 | 11/2010 | Allen et al. |
| 8,867,970 | B2 | 10/2014 | Acosta et al. |
| 8,873,995 | B2 | 10/2014 | Leemhuis |
| 8,879,953 | B2 | 11/2014 | Amann et al. |
| 9,256,198 | B2 | 2/2016 | Jang et al. |
| 9,285,758 | B1 | 3/2016 | Boettcher et al. |

(Continued)

*Primary Examiner* — Sophia S Chen
(74) *Attorney, Agent, or Firm* — Justin M. Tromp

(57) ABSTRACT

A replaceable imaging unit according to one example embodiment includes a photoconductor unit positioned at the front of a housing of the imaging unit. First and second alignment guides extend outward at the same height from first and second sides of the housing, respectively, on the photoconductor unit and run parallel to each other along a front-to-rear dimension of the housing. Each of the first and second alignment guides includes a front contact member at a front end thereof and a rear contact member at a rear end thereof. The front contact members are positioned further outward sideways than the rear contact members. Bottom surfaces of the front and rear contact members are unobstructed to permit the bottom surfaces of the front and rear contact members to sit on top of corresponding guide rails in the image forming device to control a vertical position of the imaging unit.

18 Claims, 13 Drawing Sheets

(56) References Cited

U.S. PATENT DOCUMENTS

| | | | | |
|---|---|---|---|---|
| 2003/0049046 | A1* | 3/2003 | Okabe | G03G 15/0896 399/111 |
| 2005/0191090 | A1* | 9/2005 | Nishimura | G03G 21/1821 399/113 |
| 2007/0098439 | A1* | 5/2007 | Nakada | G03G 21/1821 399/117 |
| 2014/0205316 | A1* | 7/2014 | Lee | G03G 21/1821 399/110 |
| 2017/0075292 | A1* | 3/2017 | Nagae | G03G 21/1821 |

* cited by examiner

IMAGING UNIT HAVING POSITIONAL CONTROL FEATURES FOR USE IN AN ELECTROPHOTOGRAPHIC IMAGE FORMING DEVICE

CROSS REFERENCES TO RELATED APPLICATIONS

This application claims priority to U.S. Provisional Patent Application Ser. No. 62/520,118, filed Jun. 15, 2017, entitled "Imaging Unit Having Positional Control Features For Use in an Electrophotographic Image Forming Device," the content of which is hereby incorporated by reference in its entirety.

BACKGROUND

1. Field of the Disclosure

The present disclosure relates generally to image forming devices and more particularly to an imaging unit having positional control features for use in an electrophotographic image forming device.

2. Description of the Related Art

In order to reduce the premature replacement of components traditionally housed in a toner cartridge of an electrophotographic image forming device, toner cartridge manufacturers have begun to separate components having a longer life from those having a shorter life into separate replaceable units. Relatively longer life components, such as a photoconductive drum, a cleaner blade/roll, a charge roll and a developer roll, are positioned in one replaceable unit, which may be referred to as an imaging unit. The image forming device's toner supply, which is consumed relatively quickly in comparison with the components housed in the imaging unit, is provided in a reservoir in a separate replaceable unit in the form of a toner cartridge that feeds toner to the imaging unit.

It is important that the imaging unit is precisely aligned within the image forming device. If the imaging unit is misaligned, the photoconductive drum on the imaging unit may be misaligned relative to the media sheet or intermediate transfer member that receives toner from the photoconductive drum, which may result in print defects. If the imaging unit is misaligned, a toner inlet port on the imaging unit may not seal against a toner outlet port on the toner cartridge or intermediate toner delivery member potentially causing toner leakage. Further, one or more drive couplers on the imaging unit may not achieve proper mesh with corresponding drive couplers in the image forming device if the imaging unit is misaligned. The imaging unit must also be rigidly held in place after it is installed in the image forming device in order to prevent the positional alignment of the imaging unit from being disturbed during operation. The requirement for tight positional control must be balanced with the need to permit a user to easily load and unload the imaging unit into and out of the image forming device. Accordingly, it will be appreciated that precise alignment of the imaging unit and relatively simple insertion and removal of the imaging unit into and out of the image forming device is desired.

SUMMARY

A replaceable imaging unit for use in an electrophotographic image forming device according to one example embodiment includes a housing having a top, a bottom, a front and a rear positioned between a first side and a second side of the housing. The housing includes a photoconductor unit positioned at the front of the housing. The photoconductor unit includes a rotatable photoconductive drum having a rotational axis that extends from the first side of the housing to the second side of the housing. The housing includes a developer unit having a reservoir for storing toner and a rotatable developer roll positioned to transfer toner from the reservoir to the photoconductive drum. A first alignment guide extends outward from the first side of the housing on the photoconductor unit and a second alignment guide extends outward from the second side of the housing on the photoconductor unit at the same height as the first alignment guide. The first and second alignment guides run parallel to each other along a front-to-rear dimension of the housing. Each of the first and second alignment guides includes a front contact member at a front end of said alignment guide and a rear contact member at a rear end of said alignment guide. The front contact members are positioned further outward sideways than the rear contact members. Bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device. In some embodiments, each of the front and rear contact members of the first and second alignment guides includes a roll that is rotatable relative to the housing. Some embodiments include a first blocking rib extending outward from the first side of the housing on the photoconductor unit and a second blocking rib extending outward from the second side of the housing on the photoconductor unit at the same height as the first blocking rib. The first and second blocking ribs are positioned at front portions of the first and second alignment guides directly rearward from the front contact members of the first and second alignment guides. Top surfaces of the first and second blocking ribs are positioned higher than rotational axes of the rolls of the front contact members of the first and second alignment guides.

A replaceable imaging unit for use in an electrophotographic image forming device according to another example embodiment includes a housing having a top, a bottom, a front and a rear positioned between a first side and a second side of the housing. The housing includes a photoconductor unit positioned at the front of the housing. The photoconductor unit includes a rotatable photoconductive drum having a rotational axis that extends from the first side of the housing to the second side of the housing. The housing includes a developer unit having a reservoir for storing toner and a rotatable developer roll positioned to transfer toner from the reservoir to the photoconductive drum. The housing includes a handle frame positioned at the rear of the housing and attached to the photoconductor unit. The handle frame includes a handle exposed for user engagement to assist with insertion and removal of the imaging unit into and out of the image forming device. A first alignment wing extends outward from the first side of the housing on the handle frame and a second alignment wing extends outward from the second side of the housing on the handle frame at the same height as the first alignment wing. The first and second alignment wings run parallel to each other along a front-to-rear dimension of the housing. Each of the first and second alignment wings includes an outer side surface that is unobstructed to permit the outer side surfaces to contact corresponding guides in the image forming device during insertion of the imaging unit into the image forming device. A first upstop extends outward from the first side of the housing on the handle frame at a rear end of the handle frame and a second upstop extends outward from the second side of the housing on the handle frame at the rear end of the handle frame at the same height as the first upstop. The first and second alignment wings lead rearward to the first and second upstops. The first and second upstops extend further outward sideways than the first and second alignment wings. A top portion of each of the first and second upstops is unobstructed to permit the top portions of the first and second upstops to contact the corresponding guides in the image forming device to limit upward travel of the handle frame during removal of the imaging unit from the image forming device. In some embodiments, each of the first and second alignment wings includes a tapered front portion that inclines outward sideways as the tapered front portion extends rearward. In some embodiments, each of the first and second alignment wings includes a trailing portion having a constant position in an axial dimension of the photoconductive drum. The tapered front portions of the first and second alignment wings lead rearward to the trailing portions of the first and second alignment wings.

In some embodiments, the photoconductor unit includes a drive coupler rotatably coupled to the photoconductive drum and exposed on the first side of the housing to engage a corresponding drive coupler in the image forming device when the imaging unit is installed in the image forming device. A lead-in guide is positioned on the first side of the housing immediately in front of the drive coupler of the photoconductor unit. The lead-in guide includes an inclined contact surface that inclines outward sideways as the inclined contact surface extends rearward toward the drive coupler of the photoconductor unit. The inclined contact surface is unobstructed to permit the corresponding drive coupler in the image forming device to contact the inclined contact surface during insertion of the imaging unit into the image forming device.

Some embodiments include an axial biasing surface on the first side of the housing on the photoconductor unit below the first alignment guide. The axial biasing surface includes a leading surface portion, a ramped surface portion and a trailing surface portion. The leading surface portion extends rearward from the front of the housing and leads rearward to the ramped surface portion. The ramped surface portion inclines outward sideways as the ramped surface portion extends rearward and leads rearward to the trailing surface portion. The trailing surface portion is positioned further outward sideways than the leading surface portion. The axial biasing surface is unobstructed to permit the axial biasing surface to directly receive an inward sideways biasing force from a corresponding biasing member in the image forming device to control a position of the imaging unit in the image forming device along an axial dimension of the photoconductive drum.

Some embodiments include a first foot and a second foot each formed integrally with a frame of the photoconductor unit. The first foot extends downward at the bottom of the housing on the first side of the housing and the second foot extends downward at the bottom of the housing on the second side of the housing. Bottom surfaces of the first and second feet are unobstructed to permit the bottom surfaces of the first and second feet to provide rotational stops to prevent the imaging unit from rotating about the rotational axis of the photoconductive drum when the imaging unit is installed in the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
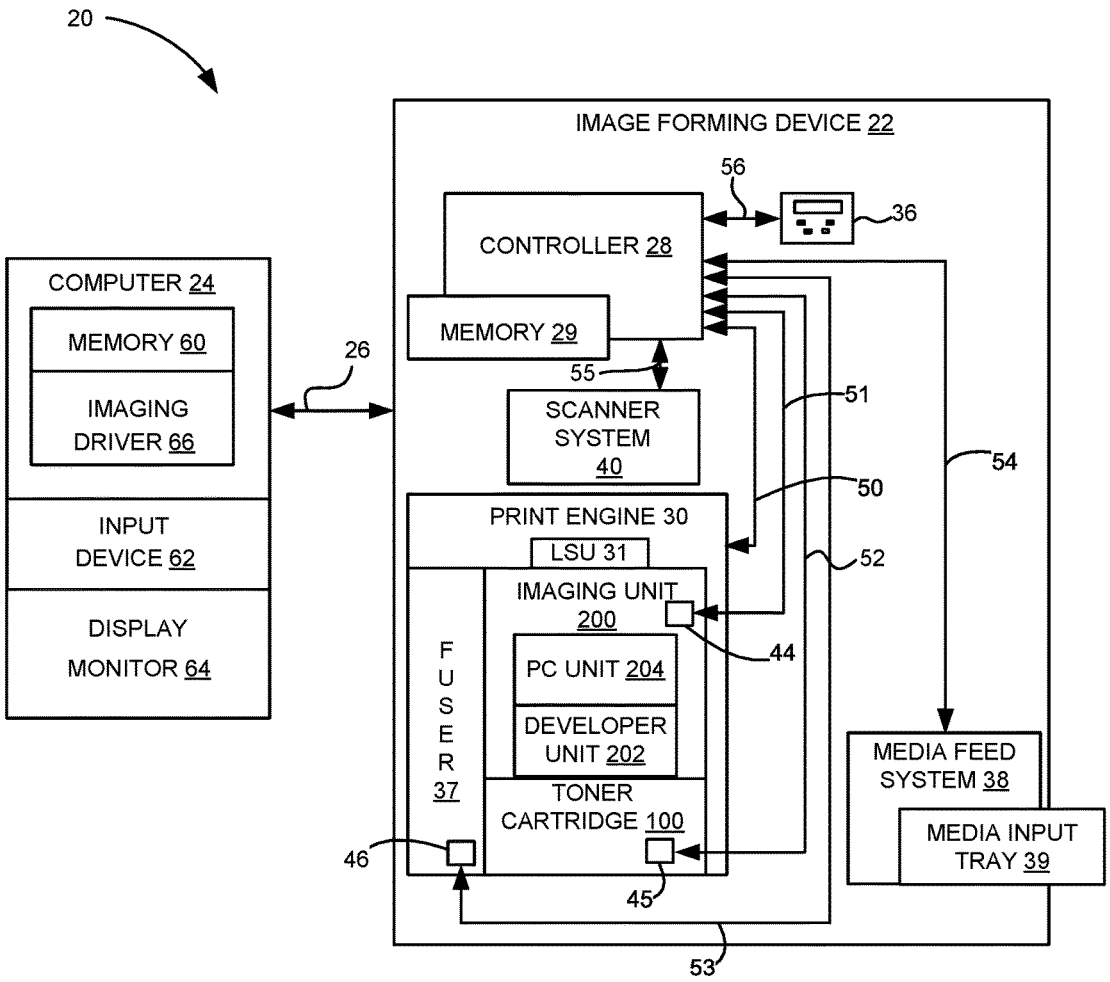
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 202 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 202 includes a developer roll that attracts the magnetic carrier beads having toner thereon to the developer roll through the use of magnetic fields. Imaging unit 200 also includes a photoconductor unit ("PC unit") 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner reservoir in developer unit 202.

The electrophotographic printing process is well known in the art and, therefore, is described briefly herein. During a printing operation, a charge roll in PC unit 204 electrically charges the outer surface of the photoconductive drum in PC unit 204 to a predetermined voltage. Laser scan unit 31 then discharges a selected portion of the outer surface of the photoconductive drum to create a latent image on the outer surface of the photoconductive drum. Toner is transferred from the toner reservoir in developer unit 202 to the latent image on the photoconductive drum by the developer roll to create a toned image on the outer surface of the photoconductive drum. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
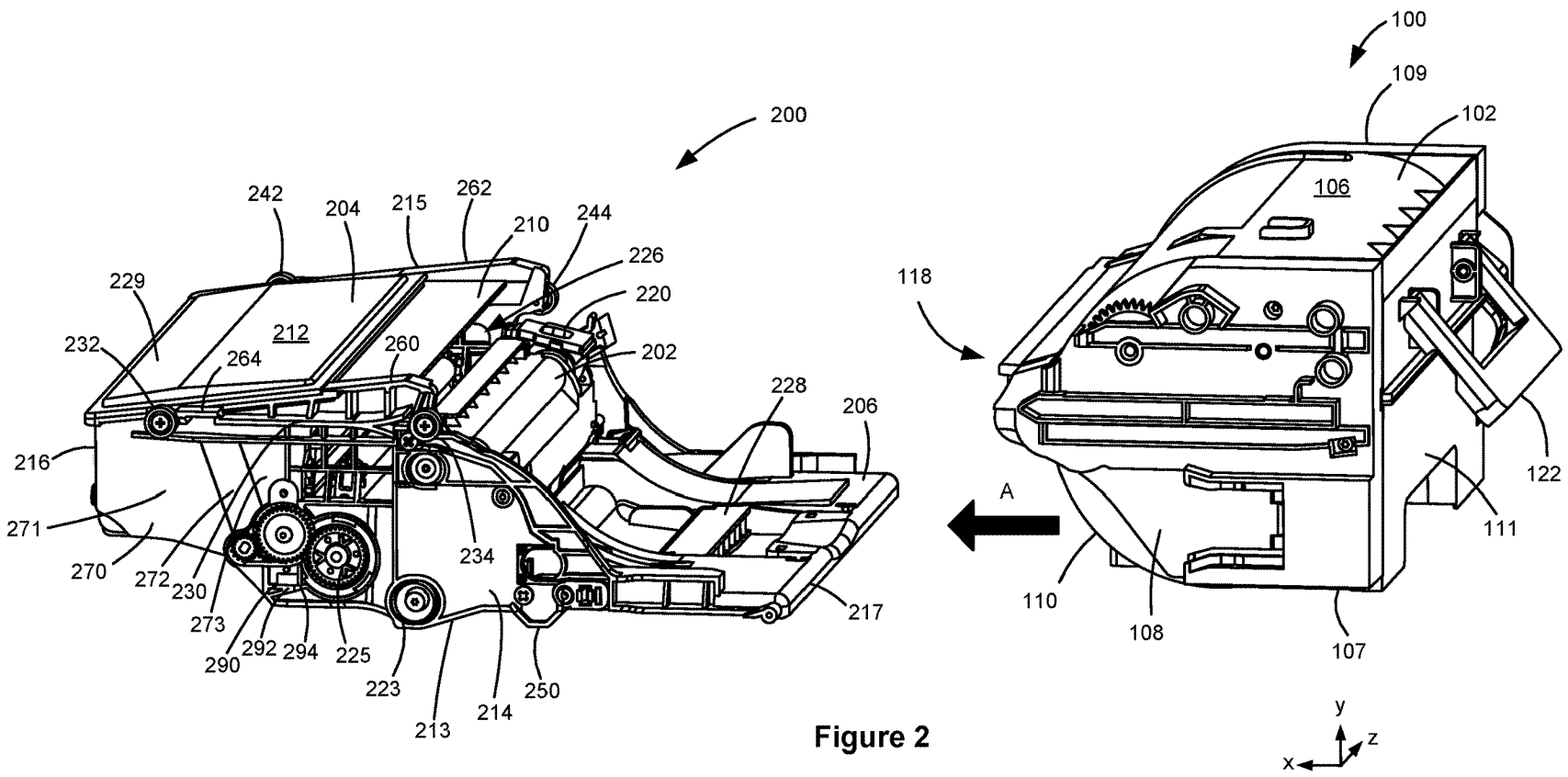
FIG. 2 is a perspective view of a toner cartridge and an imaging unit according to one example embodiment.
Figure 3:
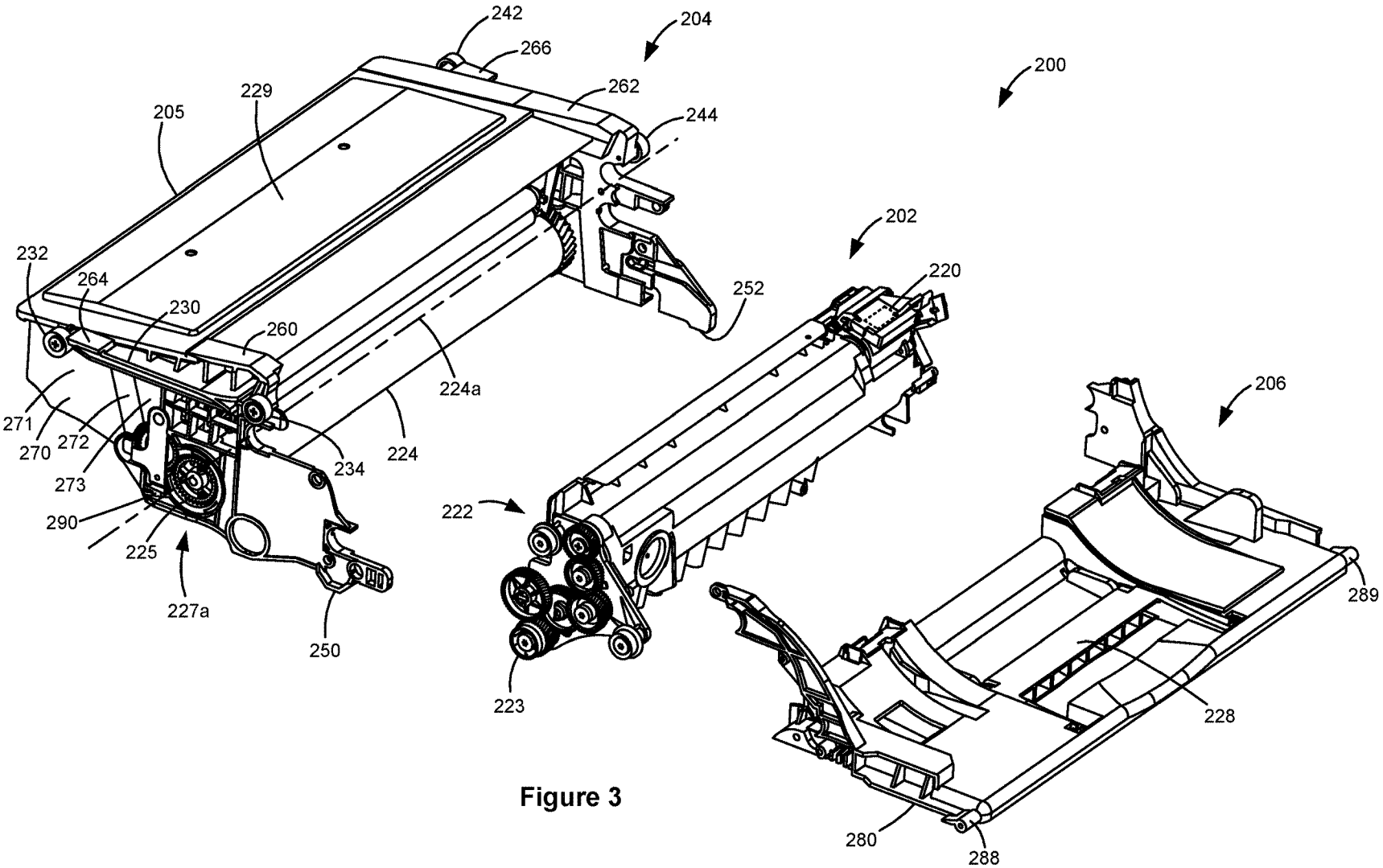
FIG. 3 is an exploded perspective view of the imaging unit shown in FIG. 2.

Referring now to FIG. 2, toner cartridge 100 and imaging unit 200 are shown according to one example embodiment. Toner cartridge 100 includes a housing 102 having an enclosed reservoir for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. An outlet port 118 in fluid communication with the reservoir of housing 102 is positioned facing downward on front 110 of housing 102 near side 109 for exiting toner from toner cartridge 100. A handle 122 may be provided on top 106 or rear 111 of housing 102 to assist with insertion and removal of toner cartridge 100 into and out of image forming device 22.

Imaging unit 200 is shown according to one example embodiment in FIGS. 2-5. In the example embodiment illustrated, imaging unit 200 includes a developer unit 202 mounted against a PC unit 204. A handle frame 206 is attached to PC unit 204. Together, developer unit 202, PC unit 204 and handle frame 206 form a housing 210 of imaging unit 200. Housing 210 includes a top 212, a bottom 213, first and second sides 214, 215, a front 216 and a rear 217. Front 216 of housing 210 leads during insertion of imaging unit 200 into image forming device 22 and rear 217 trails. PC unit 204 is positioned at front 216 of housing 210 and handle frame 206 is positioned at rear 217 of housing 210.

Developer unit 202 includes a toner inlet port 220 on top 212 of housing 210 near side 215 that is positioned to receive toner from toner cartridge 100. Toner received by inlet port 220 is stored in the toner reservoir of developer unit 202. Developer unit 202 includes a rotatable developer roll 222 that is mated with a rotatable photoconductive drum ("PC drum") 224 of PC unit 204. As discussed above, developer roll 222 transfers toner from the toner reservoir in developer unit 202 to the latent image on PC drum 224 to create a toned image on the surface of PC drum 224. Developer unit 202 may also include one or more toner agitators for mixing toner stored in the toner reservoir of developer unit 202 and may further include a toner adder roll for moving toner in the toner reservoir to the outer surface of developer roll 222. In the example embodiment illustrated, developer unit 202 includes a drive coupler 223 exposed on side 214 of housing 210. Drive coupler 223 mates with a corresponding drive coupler in image forming device 22 when imaging unit 200 is installed in image forming device 22 in order to receive rotational motion from an electric motor in image forming device 22. Drive coupler 223 is rotatably coupled to developer roll 222 via a drive train on developer unit 202 such that rotation of drive coupler 223 provides rotational motion to developer roll 222. Drive coupler 223 may also be rotatably coupled to other components of developer unit 202, such as a toner adder roll and/or various toner agitators of developer unit 202.

PC unit 204 includes a drive coupler 225 exposed on side 214 of housing 210. Drive coupler 225 mates with a corresponding drive coupler in image forming device 22 when imaging unit 200 is installed in image forming device 22 in order to receive rotational motion from an electric motor in image forming device 22. Drive coupler 225 is rotatably coupled to PC drum 224 such that rotation of drive coupler 225 provides rotational motion to PC drum 224. For example, in the embodiment illustrated, drive coupler 225 is positioned on an axial end of PC drum 224. A portion of the outer surface of PC drum 224 is exposed on bottom 213 of housing 210. Toner on the outer surface of PC drum 224 is transferred from the portion of the outer surface of PC drum 224 that is exposed on bottom 213 of housing 210 to a media sheet or intermediate transfer member during a print operation. A narrow slit 226 is formed between PC unit 204 and developer unit 202 at the top 212 of housing 210. Slit 226 permits a laser of laser scan unit 31 to discharge selected portions of the outer surface of PC drum 224 in order to create the latent image on the outer surface of PC drum 224. PC unit 204 also includes a rotatable charge roll in contact with the outer surface of PC drum 224 that charges the outer surface of PC drum 224 to a predetermined voltage. PC unit 204 also includes a waste toner removal system that may include a cleaner blade or roll that removes residual toner from the outer surface of PC drum 224. In the example embodiment illustrated, PC unit 204 includes a waste toner sump 229 positioned at the front 216 of housing 210. Waste toner sump 229 stores toner removed from PC drum 224 by the cleaner blade or roll.

Handle frame 206 includes a handle 228 exposed on housing 210 for user engagement to assist with insertion and removal of imaging unit 200 into and out of image forming device 22. Handle frame 206 may also include alignment features that aid in aligning toner cartridge 100 with imaging unit 200 during insertion of toner cartridge 100 into image forming device 22.

With reference back to FIG. 2, as discussed above, toner cartridge 100 and imaging unit 200 are each removably installable in image forming device 22. Imaging unit 200 is first slidably inserted into image forming device 22. Toner cartridge 100 is then inserted into image forming device 22 and onto handle frame 206 in a mating relationship with developer unit 202 of imaging unit 200 as indicated by the arrow A shown in FIG. 2, which also indicates the direction of insertion of toner cartridge 100 and imaging unit 200 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, photoconductor unit 204 or handle frame 206 or to clear a media jam.

When imaging unit 200 is installed in image forming device 22, various interface features of imaging unit 200 must align with corresponding interface features on toner cartridge 100 and image forming device 22. For example, PC drum 224 must be precisely positioned relative to the media path or to an intermediate transfer member (depending on whether toner is transferred directly or indirectly from PC drum 224 to the media sheets) in order to avoid print defects. Inlet port 220 of developer unit 202 must be precisely aligned and mated with outlet port 118 of toner cartridge 100 in order to avoid toner leakage between toner cartridge 100 and developer unit 202. Drive coupler 223 of developer unit 202 and drive coupler 225 of PC unit 204 must align and mate with the corresponding drive couplers in image forming device 22 in order to reliably provide rotational motion to developer roll 222 and PC drum 224. Further, various electrical contacts of imaging unit 200 may mate with and contact corresponding electrical contacts in image forming device 22. The positions of these various interface points must be tightly controlled in order to ensure proper operation of imaging unit 200. Accordingly, imaging unit 200 includes various positioning features that guide imaging unit 200 during insertion into image forming device 22 and provide precise alignment of imaging unit 200 in the final installed position of imaging unit 200 in image forming device 22.

With reference back to FIGS. 2-5, imaging unit 200 includes a pair of alignment guides 230, 240 positioned on opposite sides 214, 215 of housing 210. Specifically, alignment guide 230 extends outward from side 214 and alignment guide 240 extends outward from side 215. Alignment guides 230, 240 run parallel to each other along a front-to-rear dimension (x-dimension shown in FIG. 2) of housing 210. Alignment guides 230, 240 are positioned at the same height as each other on housing 210. In the embodiment illustrated, alignment guides 230, 240 are positioned on a frame 205 of PC unit 204. As discussed in greater detail below, alignment guides 230, 240 travel in corresponding guide slots in image forming device 22 that guide the insertion of imaging unit 200 into image forming device 22. A front contact member 232, 242 is positioned at a front end of each alignment guide 230, 240 and a rear contact member 234, 244 is positioned at a rear end of each alignment guide 230, 240. A bottom surface 233, 243 of each front contact member and a bottom surface 235, 245 of each rear contact member 234, 244 is unobstructed to permit bottom surfaces 233, 235, 243, 245 to sit on top of a corresponding guide surface in image forming device 22 in order to control the vertical position of imaging unit 200 (y-dimension shown in FIG. 2) during insertion of imaging unit 200 into image forming device 22. In the embodiment illustrated, bottom surfaces 233, 243 of front contact members 232, 242 and bottom surfaces 235, 245 of rear contact members 234, 244 extend lower (toward bottom 213 of housing 210) than the portions of alignment guides 230, 240 positioned between front contact members 232, 242 and rear contact members 234, 244. In the example embodiment illustrated, front contact members 232, 242 and rear contact members 234, 244 each include a rotatable roll that helps facilitate insertion of imaging unit 200 into image forming device 22 by decreasing the friction between front and rear contact members 232, 234, 242, 244 and the corresponding guide surfaces in image forming device 22. However, front and rear contact members 232, 234, 242, 244 may take any suitable shape and configuration. For example, in other embodiments, front contact members 232, 242 and rear contact members 234, 244 each include a static projection from a respective side 214, 215 of housing 210, such as, for example, a rounded projection.

Figure 6:
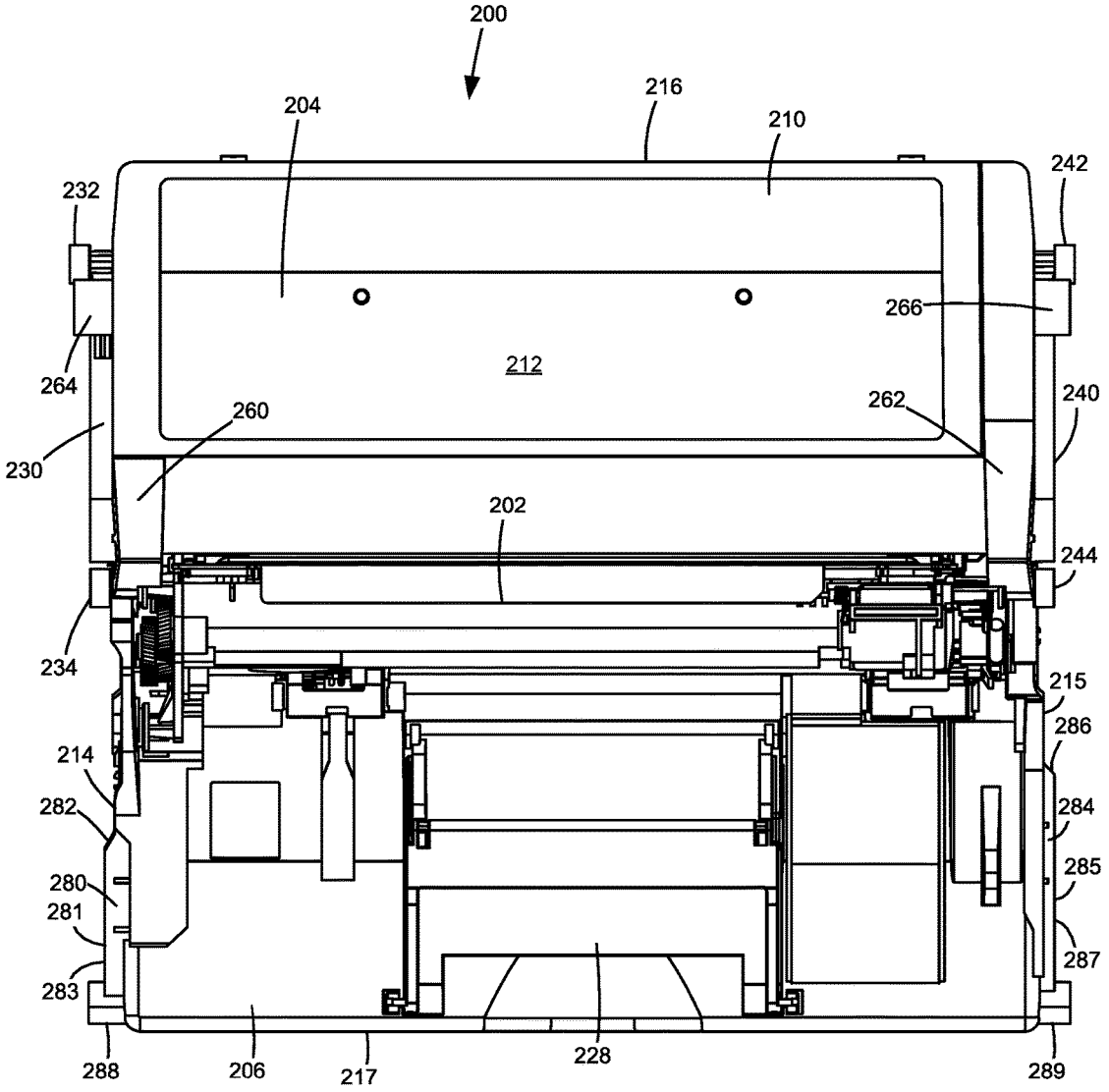
FIG. 6 is a top plan view of the imaging unit shown in FIGS. 2-5.

With reference to FIG. 6, a top plan view of imaging unit 200 is shown. In the example embodiment illustrated, front contact members 232, 242 are positioned further outward sideways than rear contact members 234, 244 are. As discussed in greater detail below, the positioning of front contact members 232, 242 at a greater width than rear contact members 234, 244 allows front contact members 232, 242 and rear contact members 234, 244 to travel on separate guide surfaces during at least a portion of the insertion of imaging unit 200 into image forming device 22.

Figure 4:
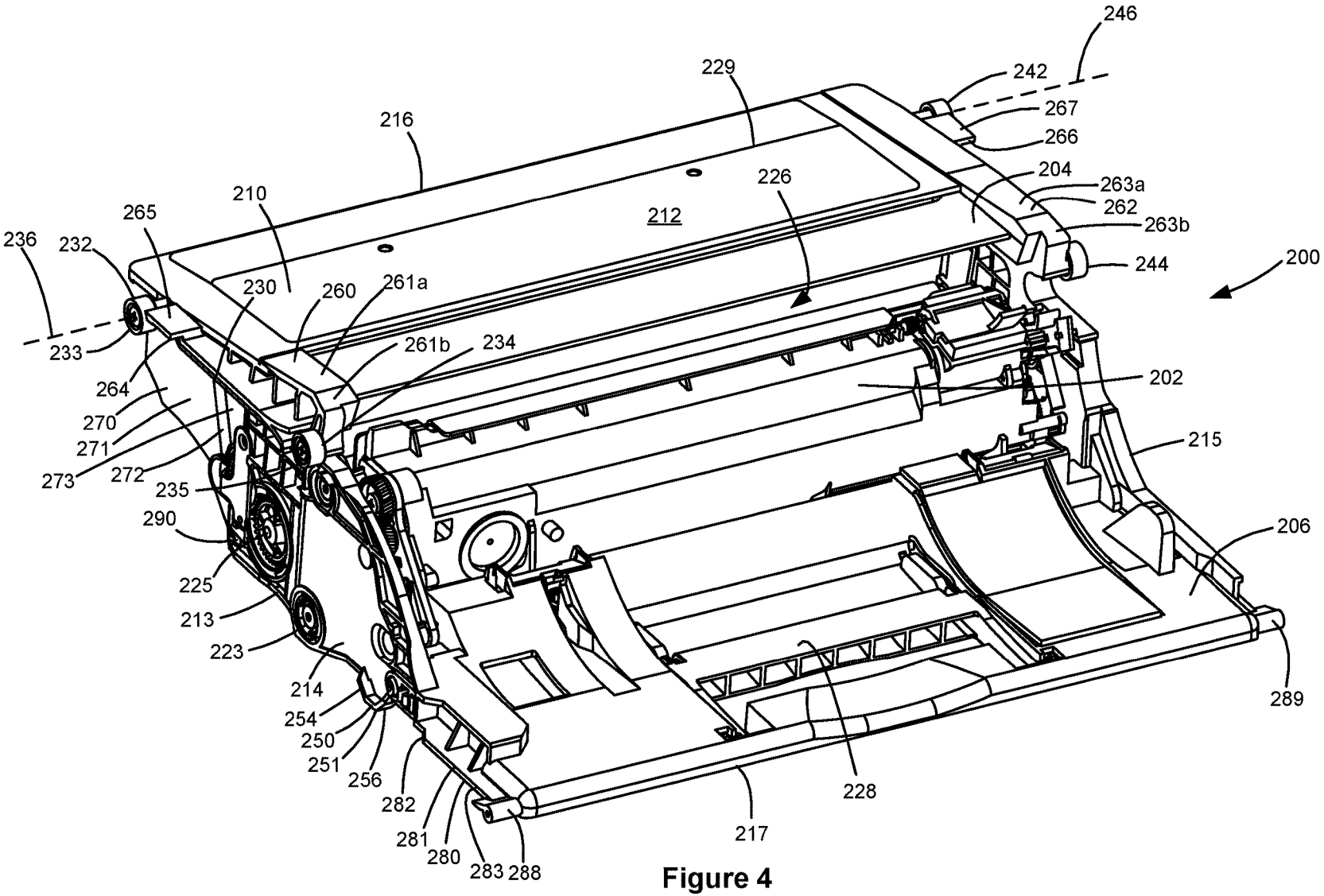
FIG. 4 is a first perspective view of the imaging unit shown in FIGS. 2 and 3.
Figure 5:
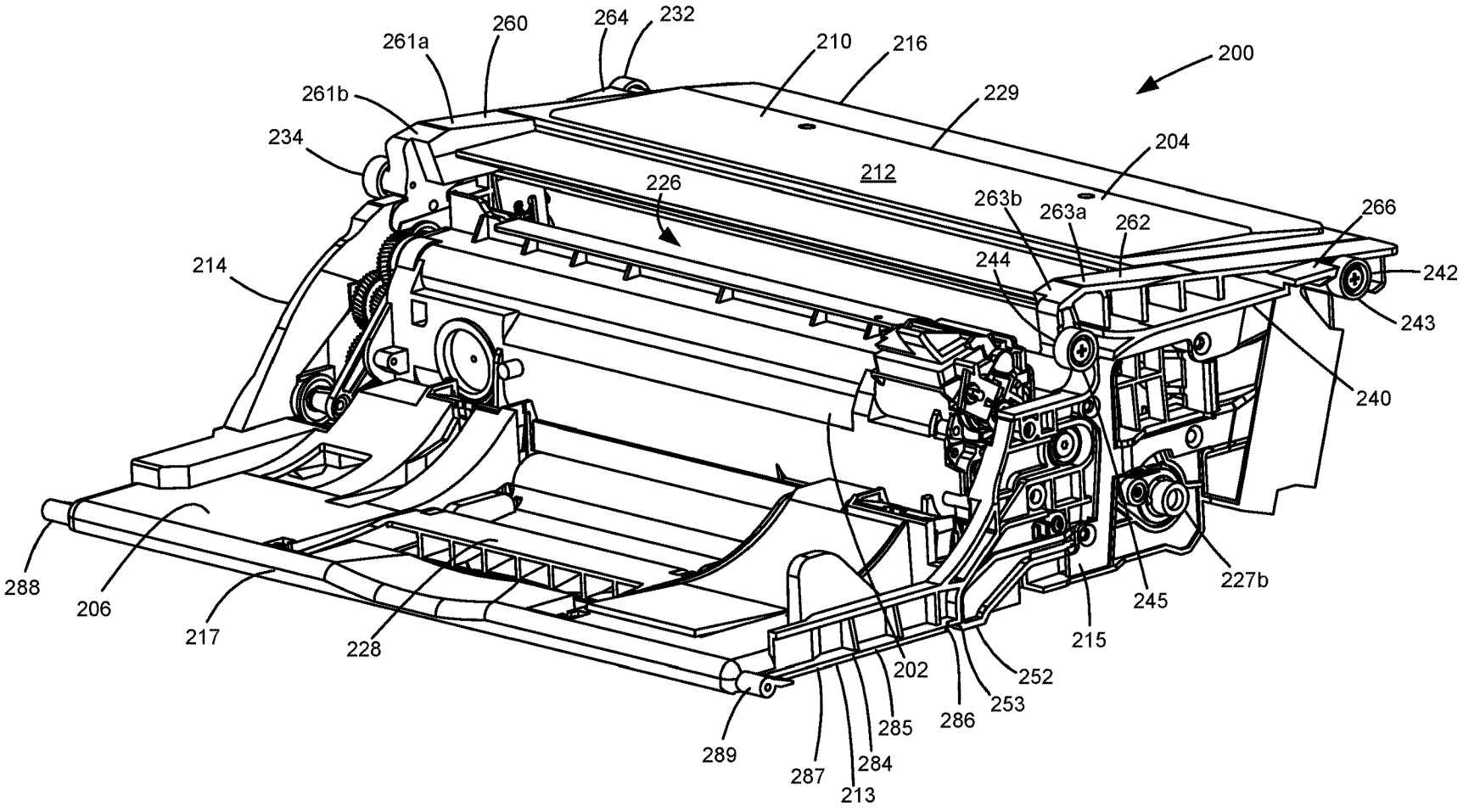
FIG. 5 is a second perspective view of the imaging unit shown in FIGS. 2-4.

With reference back to FIGS. 2-5, in some embodiments, imaging unit 200 includes a pair of feet 250, 252 that are formed integrally with frame 205 of PC unit 204 and extend downward at the bottom 213 of housing 210. Foot 250 is positioned at side 214 of housing 210 and foot 252 is positioned at side 215 of housing 210. A bottom surface 251, 253 of each foot 250, 252 is unobstructed allowing feet 250, 252 to provide rotational stops to prevent imaging unit 200 from rotating about a rotational axis 224*a* of PC drum 224 as discussed in greater detail below. In the example embodiment illustrated, foot 250 also provides axial alignment of a rear portion of imaging unit 200 when imaging unit 200 is installed in image forming device 22. As shown in FIGS. 2 and 4, in the example embodiment illustrated, foot 250 includes a tapered front face 254 that inclines upward and toward the front 216 of housing 210 and a tapered rear face 256 that inclines upward and toward the rear 217 of housing 210.

In some embodiments, imaging unit 200 also includes a pair of engagement members 260, 262 positioned on opposite sides 214, 215 of housing 210. Each engagement member 260, 262 is positioned at a topmost portion of housing 210. In the embodiment illustrated, engagement members 260, 262 are positioned on frame 205 of PC unit 204. Engagement member 260 includes an angled front surface 261*a* that faces upward and forward and an angled rear surface 261*b* that faces upward and rearward. Similarly, engagement member 262 includes an angled front surface 263*a* that faces upward and forward and an angled rear surface 263*b* that faces upward and rearward. Angled front surfaces 261*a*, 263*a* extend from the front 216 of housing toward the rear 217 of housing 210. Angled rear surfaces 261*b*, 263*b* are positioned at a rear end of PC unit 204, proximate to developer unit 202. Engagement members 260, 262 are unobstructed from above allowing engagement members 260, 262 to receive a hold down force from a corresponding biasing member in image forming device 22 to retain imaging unit 200 in its final position in image forming device 22 as discussed in greater detail below.

Imaging unit 200 may also include a pair of blocking ribs 264, 266 positioned on opposite sides 214, 215 of housing 210. Specifically, blocking rib 264 extends outward from side 214 and blocking rib 266 extends outward from side 215. Blocking ribs 264, 266 are positioned on frame 205 of PC unit 204. Each blocking rib 264, 266 is positioned at a front portion of a respective alignment guide 230, 240 and is aligned in a side-to-side dimension (z-dimension of FIG. 2) of housing 210, which is parallel to rotational axis 224*a* of PC drum 224, with the respective alignment guide 230, 240. Each blocking rib 264, 266 is positioned directly rearward from front contact member 232, 242 of the corresponding alignment guide 230, 240. A top surface 265, 267 of each blocking rib 264, 266 is positioned higher than a rotational axis 236, 246 of each front contact member 232, 242. As discussed in greater detail below, blocking ribs 264, 266 prevent a toner cartridge hold-down feature in image forming device 22 from applying a hold-down force to front contact members 232, 242 which could trap imaging unit 200 in image forming device 22 if imaging unit 200 is inadvertently installed along the insertion path for toner cartridge 100 instead of the proper insertion path for imaging unit 200.

In some embodiments, imaging unit 200 includes an axial biasing surface 270 positioned on side 214 of housing 210. Axial biasing surface 270 is positioned on frame 205 of PC unit 204, lower than alignment guide 230. Axial biasing surface 270 includes a leading surface portion 271 that extends rearward from the front 216 of housing 210. In the embodiment illustrated, leading surface portion 271 includes a planar surface on side 214 that is parallel to the front-to-rear dimension of housing 210, having a constant position in the side-to-side dimension of housing 210. Leading surface portion 271 leads rearward along the direction of insertion of imaging unit 200 into image forming device 22 to a ramped surface portion 272 of axial biasing surface 270. Ramped surface portion 272 inclines outward sideways relative to leading surface portion 271 as ramped surface portion 272 extends rearward. In the embodiment illustrated, ramped surface portion 272 includes a planar surface on side 214 that inclines outward sideways as the planar surface extends rearward. Ramped surface portion 272 leads rearward along the direction of insertion of imaging unit 200 into image forming device 22 to a trailing surface portion 273 of axial biasing surface 270. Trailing surface portion 273 is positioned further outward sideways than leading surface portion 271. In the embodiment illustrated, trailing surface portion 273 includes a planar surface on side 214 that is parallel to the front-to-rear dimension of housing 210 (parallel to leading surface portion 271), having a constant position in the side-to-side dimension of housing 210. Trailing surface portion 273 is positioned higher than rotational axis 224*a* of PC drum 224. Leading surface portion 271, ramped surface portion 272 and trailing surface portion 273 of axial biasing surface 270 are unobstructed from the side allowing axial biasing surface 270 to receive an inward sideways axial biasing force from a corresponding biasing member in image forming device 22 to align imaging unit 200 in the side-to-side dimension of housing 210 as discussed in greater detail below.

In some embodiments, handle frame 206 of imaging unit 200 includes a pair of alignment wings 280, 284 extending outward sideways in opposite directions. Specifically, alignment wing 280 extends outward sideways from side 214 and alignment wing 284 extends outward sideways from side 215. Alignment wings 280, 284 run parallel to each other along the front-to-rear dimension of housing 210. Alignment wings 280, 284 are positioned at the same height as each other on housing 210. Each alignment wing 280, 284 includes an outer side surface 281, 285 that is unobstructed allowing the outer side surface 281, 285 to contact a corresponding guide in image forming device 22 to aid in aligning handle frame 206 in the side-to-side dimension of housing 210 during insertion of imaging unit 200 into image forming device 22 as discussed in greater detail below. Each outer side surface 281, 285 of alignment wings 280, 284 includes a tapered front portion 282, 286 that inclines outward sideways as the tapered front portion 282, 286 extends rearward. Each tapered front portion 282, 286 leads rearward to a trailing portion 283, 287 of the outer side surface 281, 285. Each trailing portion 283, 287 is parallel to the front-to-rear dimension of housing 210, having a constant position in the side-to-side dimension of housing 210.

In some embodiments, handle frame 206 of imaging unit 200 also includes a pair of upstops 288, 289 extending outward sideways in opposite directions. Specifically, upstop 288 extends outward sideways from side 214 and upstop 289 extends outward sideways from side 215. Upstops 288, 289 are positioned at the same height as each other on housing 210. Upstops 288, 289 are positioned at a rear end of handle frame 206 with trailing portions 283, 287 of outer side surfaces 281, 285 of alignment wings 280, 284 leading rearward to upstops 288, 289. In the embodiment illustrated, upstops 288, 289 extend further outward sideways than alignment wings 280, 284. In the example embodiment illustrated, each upstop 288, 289 is formed as a rounded projection from handle frame 206, however, other shapes and forms may be used as desired. A top portion of each upstop 288, 289 is unobstructed allowing upstops 288, 289 to contact a corresponding guide in image forming device 22 to limit the upward travel of handle frame 206 during removal of imaging unit 200 from image forming device 22 as discussed in greater detail below.

Imaging unit 200 may include a lead-in guide 290 positioned immediately in front of drive coupler 225 of PC drum 224 on side 214 of housing 210. Lead-in guide 290 includes an inclined contact surface 292 that inclines outward sideways as contact surface 292 extends rearward toward drive coupler 225 of PC drum 224. In the embodiment illustrated, lead-in guide 290 also includes a contact surface 294 that is positioned directly rearward from contact surface 292. Contact surface 294 is parallel to the front-to-rear dimension of housing 210, having a constant position in the side-to-side dimension of housing 210. Contact surfaces 292, 294 of lead-in guide 290 are unobstructed allowing a drive coupler in image forming device 22 that provides rotational motion to drive coupler 225 to contact surfaces 292, 294 permitting contact surfaces 292, 294 of lead-in guide 290 to aid in aligning the drive coupler in image forming device 22 with drive coupler 225 as discussed in greater detail below.

FIGS. 7-10 are sequential views showing the insertion of imaging unit 200 into image forming device 22. FIGS. 7-10 show the position of side 214 of imaging unit 200 in relation to various engagement features in image forming device 22 (which are shown in isolation so as not to obscure the view of imaging unit 200) as imaging unit 200 is inserted into image forming device 22.

Figure 7:
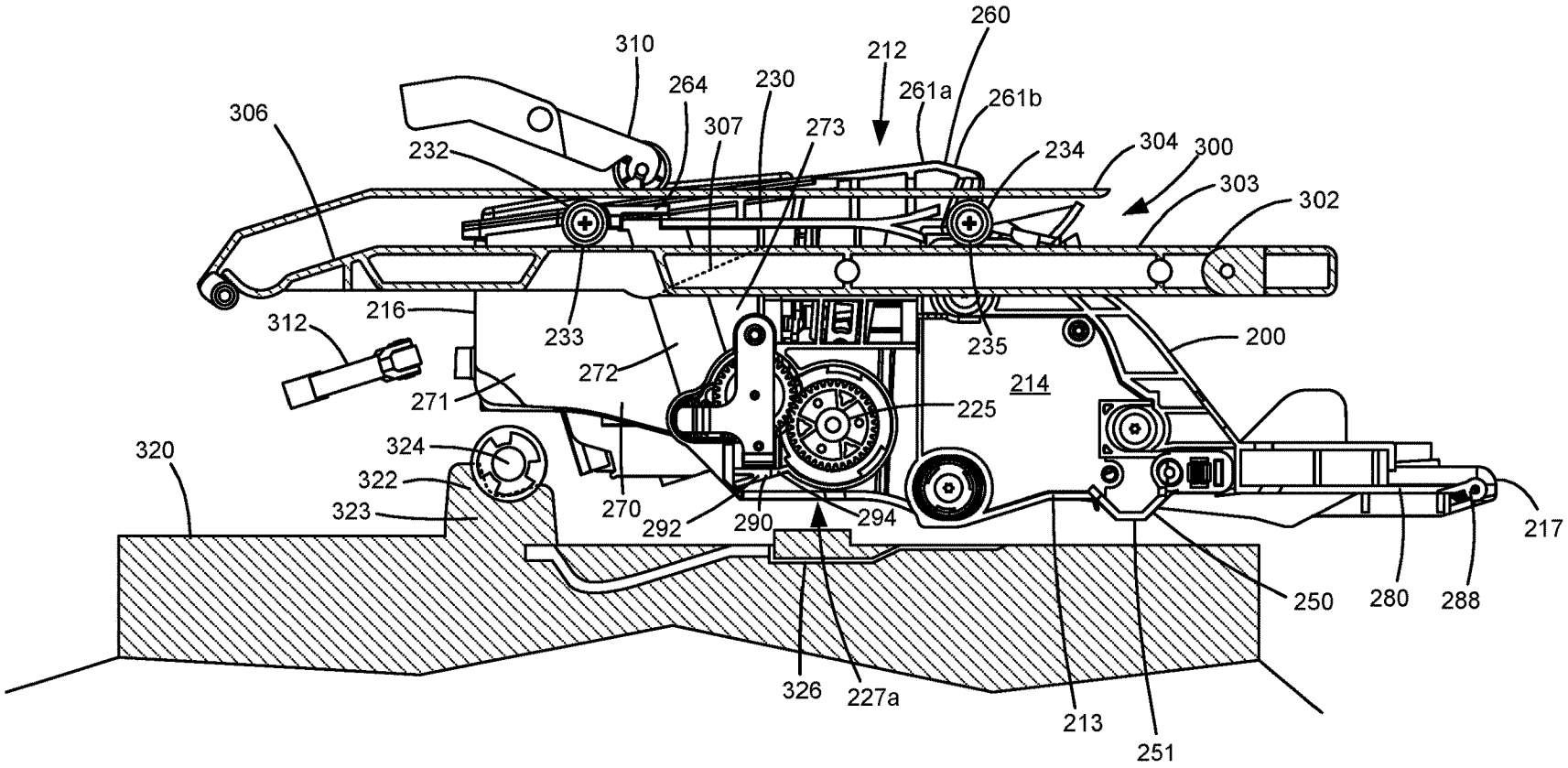
FIGS. 7-10 are sequential side elevation views showing the position of the imaging unit relative to various features of an image forming device during insertion of the imaging unit into the image forming device according to one example embodiment.

FIG. 7 shows imaging unit 200 during insertion into image forming device 22. Alignment guide 230 is positioned within a guide slot 300 in image forming device 22. Guide slot 300 is formed by a bottom guide rail 302 and a top guide rail 304. Bottom surfaces 233, 235 of front and rear contact members 232, 234 of alignment guide 230 are in contact with a top surface 303 of bottom guide rail 302. Similarly, bottom surfaces 243, 245 of front and rear contact members 242, 244 of alignment guide 240 are in contact with a corresponding guide in image forming device 22 on side 215 of imaging unit 200. The engagement between alignment guides 230, 240 and the corresponding guide slots in image forming device 22 (such as guide slot 300) guides the insertion of imaging unit 200 into image forming device 22. In the embodiment illustrated, front and rear contact members 232, 234, 242, 244 of alignment guides 230, 240 roll along the top surfaces of the bottom guides of the guide slots (such as guide slot 300) as imaging unit 200 advances into image forming device 22. The contact between bottom surfaces 233, 235, 243, 245 of front and rear contact members 232, 234, 242, 244 of alignment guides 230, 240 and the corresponding guides (such as bottom guide rail 302) controls the vertical position of imaging unit 200 during insertion into image forming device 22.

FIG. 7 also shows a biasing member 310 in contact with and applying a hold down force to angled front surface 261*a* of engagement member 260. A similar biasing member is in contact with and applying a hold down force to angled front surface 263*a* of engagement member 262 on side 215 of imaging unit 200. The contact between angled front surfaces 261*a*, 263*a* of engagement members 260, 262 and the corresponding biasing members (such as biasing member 310) helps force bottom surfaces 233, 235, 243, 245 of front and rear contact members 232, 234, 242, 244 of alignment guides 230, 240 into contact with their corresponding guides in image forming device 22 and helps control the insertion of imaging unit 200 into image forming device 22. FIG. 7 also shows an axial biasing member 312 positioned in front of imaging unit 200 and a frame 320 of image forming device 22 positioned below imaging unit 200. Frame 320 includes a V-block 322 that positions PC drum 224 of imaging unit 200 as well as a drive coupler 324 that mates with and provides rotational motion to drive coupler 225 of PC drum 224 as discussed below. Frame 320 also includes a datum surface 326 that receives foot 250 as discussed below.

Figure 8:
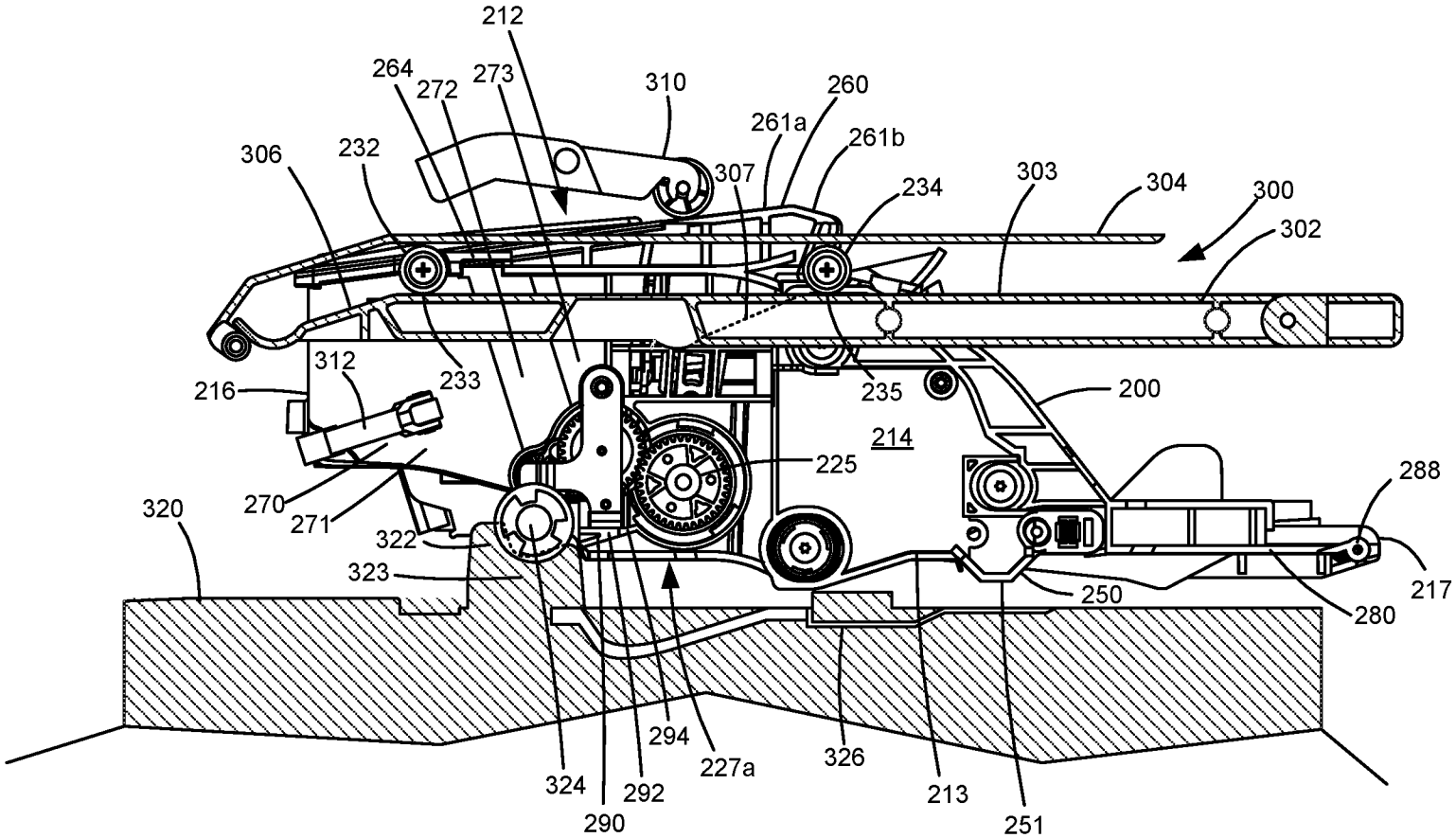

FIG. 8 shows imaging unit 200 advanced further into image forming device 22. Alignment guide 230 is advanced further into guide slot 300 and bottom surfaces 233, 235 of front and rear contact members 232, 234 of alignment guide 230 are in contact with top surface 303 of bottom guide rail 302 as discussed above. Biasing member 310 has advanced toward rear 217 of housing 210 and remains in contact with angled front surface 261*a* of engagement member 260 as discussed above. Leading surface portion 271 of axial biasing surface 270 has advanced to axial biasing member 312. Depending on the position of imaging unit 200 along the side-to-side dimension of housing 210, axial biasing member 312 may apply an inward biasing force along the side-to-side dimension of housing 210 (into the page as viewed in FIG. 8) against leading surface portion 271 to help control the horizontal position of imaging unit 200 along the side-to-side dimension of housing 210 during insertion of imaging unit 200 into image forming device 200.

Figure 9:
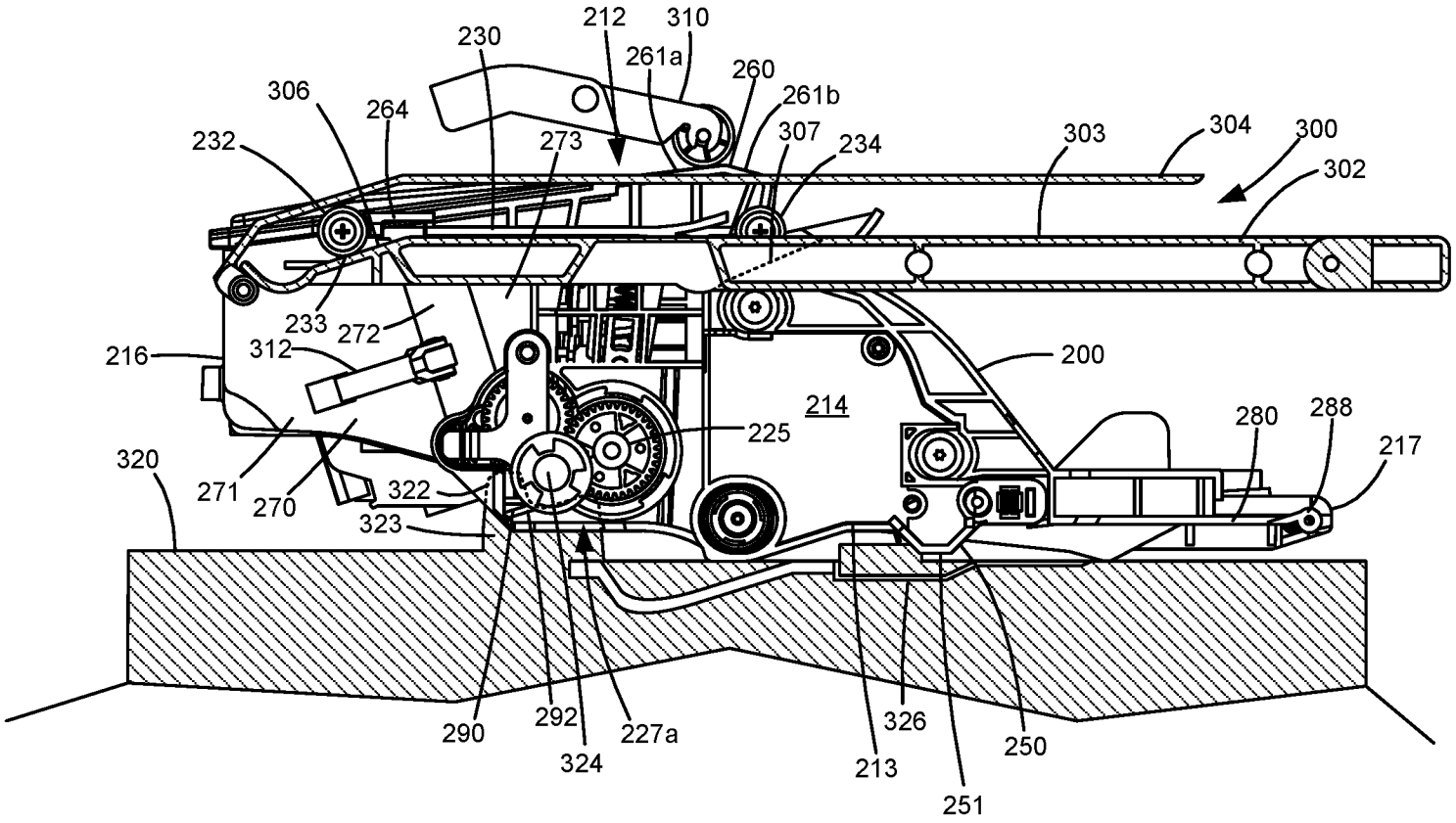

FIG. 9 shows imaging unit 200 advanced further into image forming device 22. Alignment guide 230 is advanced further into guide slot 300. Bottom surface 233 of front contact member 232 of alignment guide 230 has begun to advance down a ramped surface 306 of bottom guide rail 302 and bottom surface 235 of rear contact member 234 of alignment guide 230 has begun to advance down a ramped surface 307 of bottom guide rail 302. Ramped surface 307 is spaced inward sideways (toward side 214 of imaging unit 200) from ramped surface 306. As a result, as imaging unit 200 advances into image forming device 22, front contact member 232 of alignment guide 230 travels past ramped surface 307 and does not travel down ramped surface 307 due to the wider position of front contact member 232 in comparison with rear contact member 234. Front and rear contact members 242, 244 of alignment guide 240 travel down similar ramped surfaces on side 215 of imaging unit 200. The movement of front and rear contact members 232, 234, 242, 244 down the ramped surfaces causes imaging unit 200 to lower as imaging unit 200 advances toward its final position in image forming device 22.

In FIG. 9, biasing member 310 has advanced further toward rear 217 of housing 210 and remains in contact with angled front surface 261*a* of engagement member 260 as discussed above. Axial biasing member 312 has advanced past leading surface portion 271 of axial biasing surface 270 to contact ramped surface portion 272 of axial biasing surface 270. Axial biasing member 312 applies an inward biasing force along the side-to-side dimension of housing 210 against ramped surface portion 272. Depending on the position of imaging unit 200 along the side-to-side dimension of housing 210, the bias applied by axial biasing member 312 may cause imaging unit 200 to shift away from axial biasing member 312 (into the page as viewed in FIG. 9) as imaging unit 200 advances due to the incline of ramped surface portion 272. In this manner, the contact between axial biasing member 312 and ramped surface portion 272 more finely controls the horizontal position of imaging unit 200 along the side-to-side dimension of housing 210.

FIG. 9 shows drive coupler 324 contacting lead-in guide 290 on side 214 of housing 210. Drive coupler 324 is movable axially relative to rotational axis 224*a* of PC drum 224, toward and away from side 214 of housing 210 and drive coupler 225 of PC drum 224. Drive coupler 324 is biased toward side 214 of housing 210. As drive coupler 324 engages lead-in guide 320, drive coupler 324 first contacts inclined contact surface 292 of lead-in guide 290. Contact between inclined contact surface 292 of lead-in guide 290 and drive coupler 324 causes drive coupler 324 to move against the bias on drive coupler 324, away from side 214 of housing 210, due to the incline of contact surface 292 of lead-in guide 290. Drive coupler 324 then contacts contact surface 294 (FIGS. 8 and 10) of lead-in guide 290 as imaging unit 200 advances further into image forming device 22. Contact between contact surface 294 of lead-in guide 290 and drive coupler 324 maintains the position of drive coupler 324 in the side-to-side dimension of housing 210.

Figure 10:
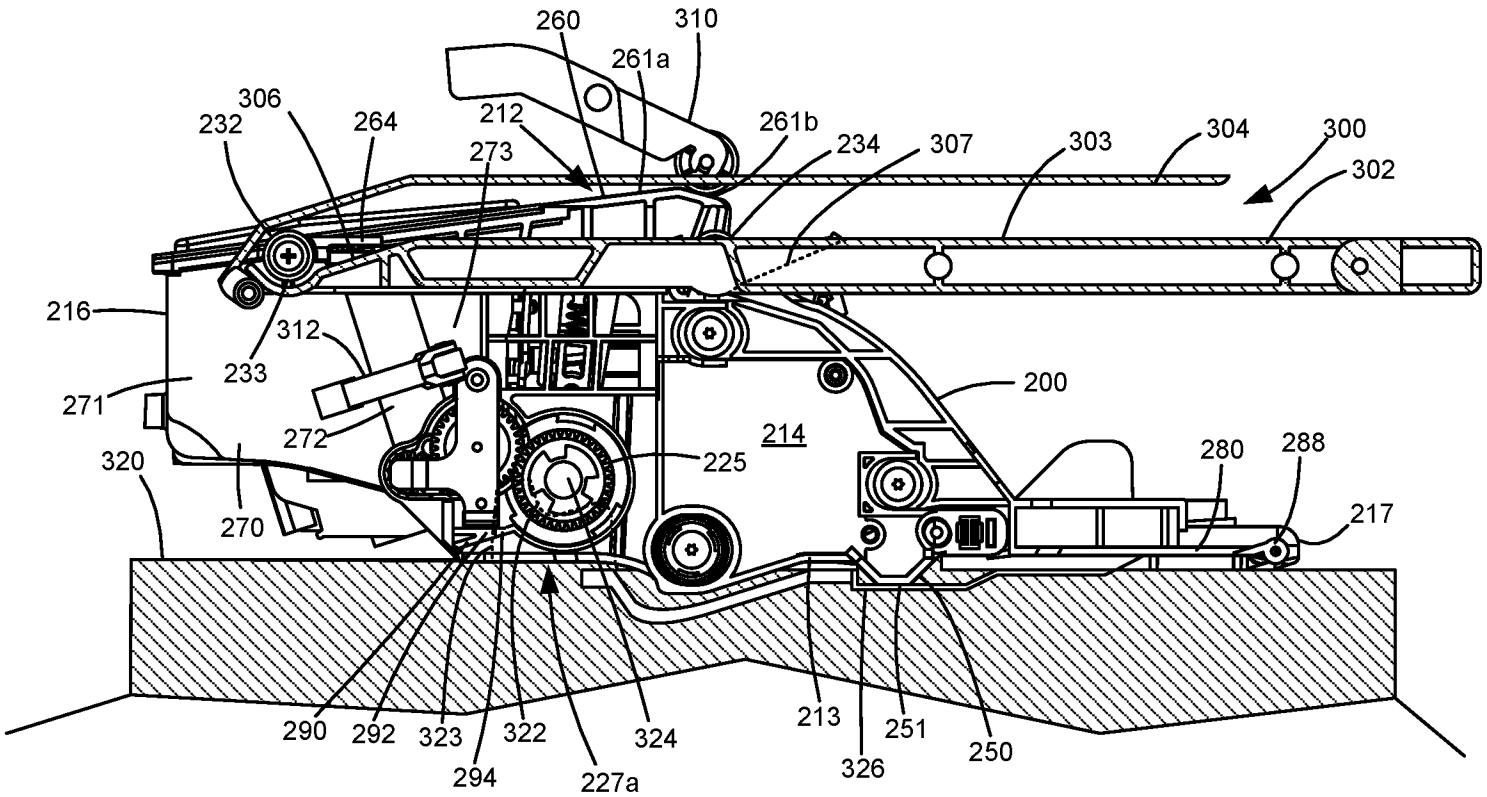

FIG. 10 shows imaging unit 200 in its final installed position in image forming device 22. Alignment guide 230 is fully advanced into guide slot 300. Front and rear contact members 232, 234 have advanced fully down ramped surfaces 306, 307. Similarly, alignment guide 240 is fully advanced into the corresponding guide slot with front and rear contact members 242, 244 fully advanced down the corresponding ramped surfaces. In the example embodiment illustrated, in the final position of imaging unit 200, bottom surfaces 233, 235, 243, 245 of front and rear contact members 232, 234, 242, 244 of alignment guides 230, 240 are spaced above bottom guide rail 302 such that alignment guides 230, 240 do not define the vertical position of imaging unit 200 in image forming device 22 once imaging unit 200 reaches its final installed position. Rather, as imaging unit 200 lowers to the final position in image forming device 22, a bearing 227*a* of PC drum 224 positioned axially inboard of drive coupler 225 on side 214 of housing 210 lowers into V-block 322. Similarly, a bearing 227*b* (FIG. 5) of PC drum 224 on side 215 of housing 210 lowers into a corresponding V-block as imaging unit 200 lowers to the final installed position in image forming device 22. The contact between bearings 227*a*, 227*b* and the corresponding V-blocks defines the vertical position of imaging unit 200 and the horizontal position of imaging unit 200 in the front-to-rear dimension of housing 210 when imaging unit 200 in the final installed position in image forming device 22. The positioning of imaging unit 200 by way of the contact between bearings 227*a*, 227*b* of PC drum 224 and the V-blocks permits precise location of PC drum 224 relative to the media (or intermediate transfer member) that receives toner from PC drum 224 due to tight positional control between bearings 227*a*, 227*b* and PC drum 224. This, in turn, aids in reducing the occurrence of print defects due to misalignment of PC drum 224 relative to the media (or intermediate transfer member) that receives toner from PC drum 224.

As imaging unit 200 advances to the final position in image forming device 22, a trailing end of drive coupler 324 passes contact surface 294 of lead-in guide 290 and drive coupler 324 disengages from contact surface 294. When drive coupler 324 disengages from contact surface 294, drive coupler 324 moves in the direction of bias on drive coupler 324, toward side 214 of housing 210, and axially engages drive coupler 225 of PC drum 224 permitting drive coupler 324 to transfer rotational motion to drive coupler 225 of PC drum 224. The tight positional control of PC drum 224 by the V-blocks (such as V-block 322) also aids in preventing misalignment between drive coupler 324 and drive coupler 225 of PC drum 224 in order to ensure that drive coupler 324 meshes properly with drive coupler 225 of PC drum 224.

FIG. 10 also shows that in the final position of imaging unit 200, foot 250 sits on datum surface 326 on frame 320. Similarly, foot 252 on side 215 of housing 210 sits on a corresponding datum surface on a frame of image forming device 22. The engagement between feet 250, 252 and the corresponding datum surfaces provides a rotational stop at each side 214, 215 of housing 210 in order to prevent rear 217 of housing 210 from rotating downward and front 216 of housing 210 from rotating upward about rotation axis

224*a* of PC drum 224. Positioning feet 250, 252 on frame 205 (FIG. 3) of PC unit 204 instead of on developer unit 202 or handle frame 206 helps minimize tolerance stack-up between feet 250, 252 and PC unit 204 in order to more finely control the position of PC drum 224.

In the final position of imaging unit 200, biasing member 310 is in contact with angled rear surface 261*b* of engagement member 260 and a similar biasing member is in contact with angled rear surface 263*b* of engagement member 262. Each biasing member applies a hold-down force to angled rear surfaces 261*b*, 263*b* of engagement members 260, 262 that keeps bearings 227*a*, 227*b* of PC drum 224 pressed against the corresponding V-blocks so that imaging unit 200 does not drift rearward or upward away from the V-blocks during operation in order to maintain precise positioning of PC drum 224. As mentioned above, blocking ribs 264, 266 prevent a toner cartridge hold-down feature similar to biasing member 310 from applying a hold-down force to front contact members 232, 242 which could trap imaging unit 200 in image forming device 22 if imaging unit 200 is inadvertently installed along the insertion path for toner cartridge 100 instead of the proper insertion path for imaging unit 200.

In the final position of imaging unit 200, axial biasing member 312 is in contact with trailing surface portion 273 of axial biasing surface 270. Axial biasing member 312 applies an inward biasing force along the side-to-side dimension of housing 210 against trailing surface portion 273. When imaging unit 200 is in the final installed position in image forming device 22, the force from axial biasing member 312 presses an inner surface of frame 205 (FIG. 3) of PC unit 204 that surrounds bearing 227*a* of PC drum 224 on side 214 against an outer side surface 323 of V-block 322. The contact between the inner surface of frame 205 of PC unit 204 and outer side surface 323 of V-block 322 controls the horizontal position of imaging unit 200 along the side-to-side dimension of housing 210 when imaging unit 200 is in the final installed position in image forming device 22. The positioning of imaging unit 200 by way of the contact between frame 205 of PC unit 204 and V-block 322 permits precise location of PC drum 224 relative to the media (or intermediate transfer member) that receives toner from PC drum 224 due to tight positional control between frame 205 and PC drum 224. As mentioned above, in the example embodiment illustrated, foot 250 provides axial alignment of a rear portion of imaging unit 200 when imaging unit 200 is in the final installed position in image forming device 22 to more finely control the position of imaging unit 200. Specifically, in one embodiment, foot 250 is closely received in a slot formed by a pair of walls on frame 320 of image forming device 22 that are spaced from each other in the side-to-side dimension of housing 210.

Figure 11:
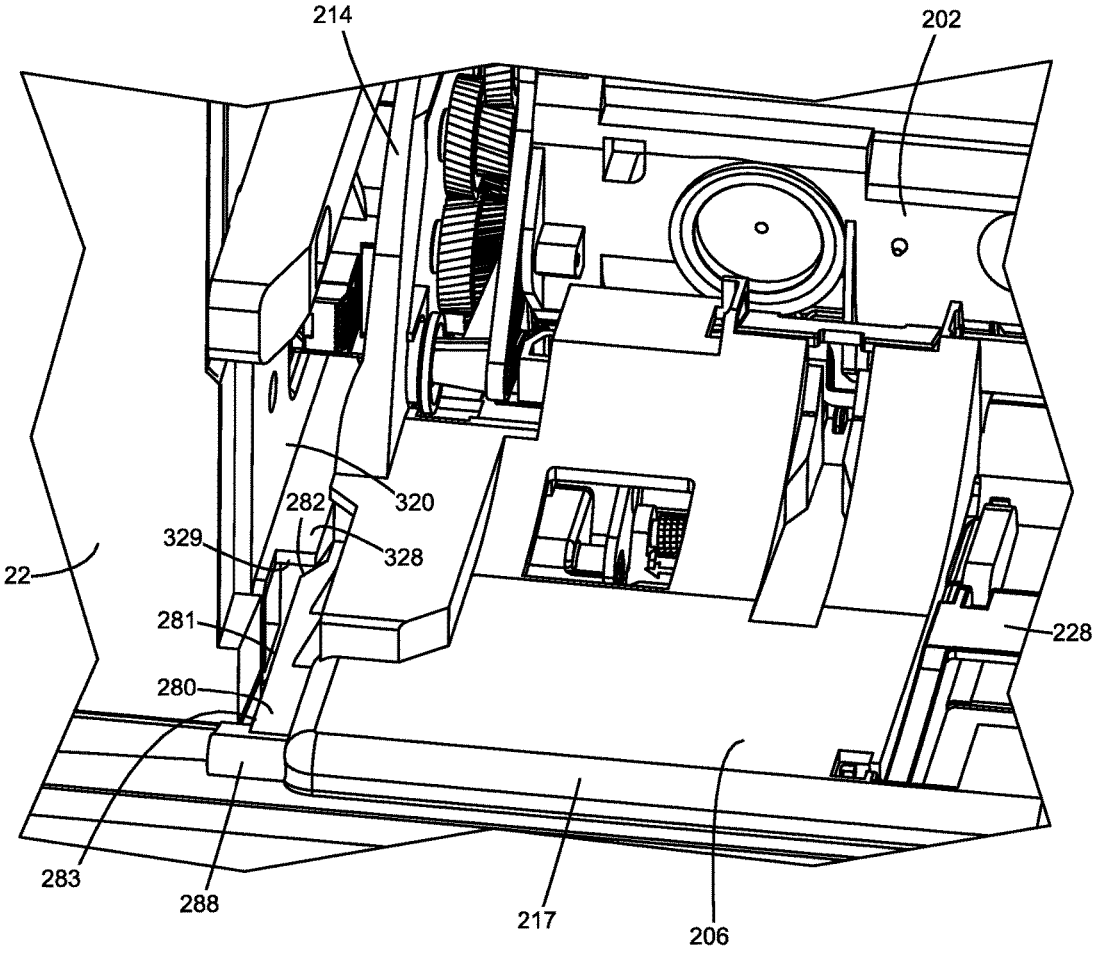
FIGS. 11-13 are sequential perspective views showing the position of a handle frame of the imaging unit relative to the various features of the image forming device during insertion of the imaging unit into the image forming device according to one example embodiment.
Figure 12:
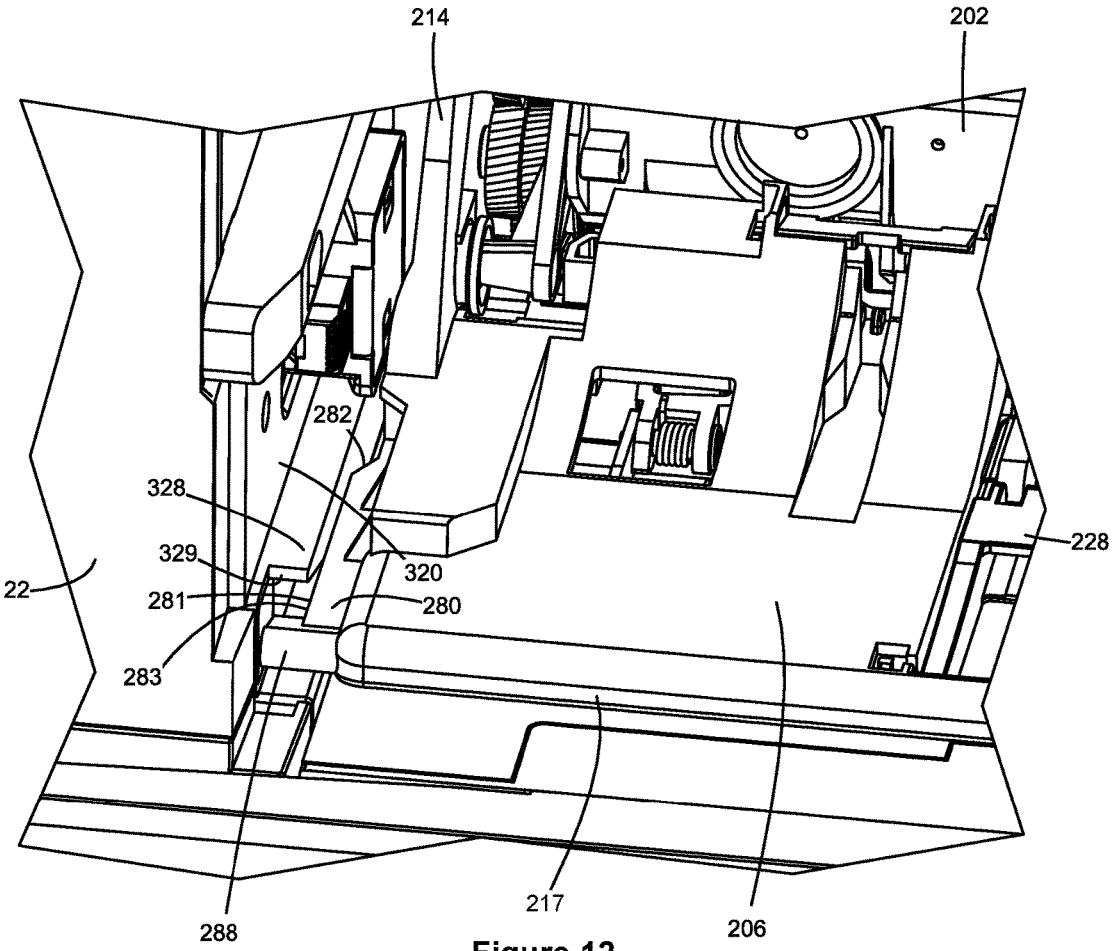
Figure 13:
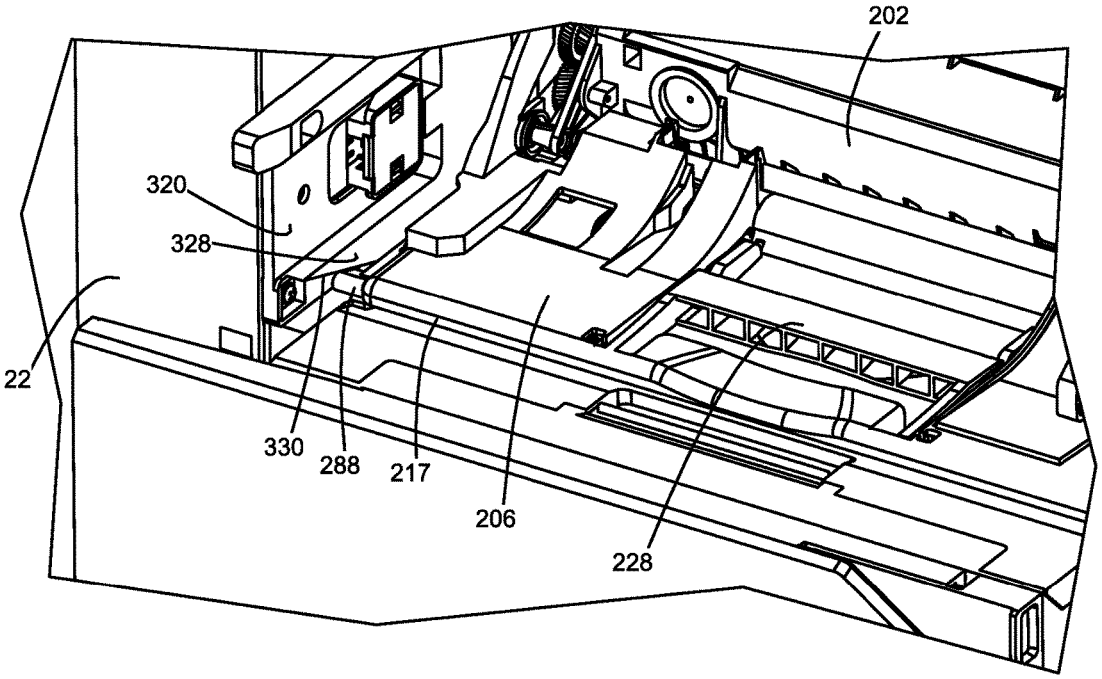

FIGS. 11-13 are sequential views showing the area of handle frame 206 during the insertion of imaging unit 200 into image forming device 22. As shown in FIG. 11, as imaging unit 200 is inserted into image forming device 22, alignment wing 280 passes in close proximity to a side wall 328 of frame 320 in image forming device 22. Similarly, alignment wing 284 passes in close proximity to a side wall in image forming device 22 on side 215 of imaging unit 200. If handle frame 206 is misaligned in the side-to-side dimension of housing 210 during insertion of imaging unit 200, tapered front portion 282 of outer side surface 281 of alignment wing 280 contacts a leading end 329 of side wall 328 (or tapered front portion 286 of outer side surface 285 of alignment wing 284 contacts a leading end of the corresponding side wall). The contact between leading end 329 of side wall 328 and tapered front portion 282 causes handle frame 206 to shift in the side-to-side dimension of housing 210 as imaging unit 200 advances due to the angle of tapered front portion 282 in order to realign handle frame 206 in the side-to-side dimension of housing 210. With reference to FIG. 12, as imaging unit 200 advances further into image forming device 22, if handle frame 206 is misaligned in the side-to-side dimension of housing 210, trailing portion 283 of outer side surface 281 of alignment wing 280 contacts side wall 328 (or trailing portion 287 of outer side surface 285 of alignment wing 284 contacts the corresponding side wall) in order to maintain alignment of handle frame 206 in the side-to-side dimension of housing 210.

FIG. 13 shows imaging unit 200 in the final installed position in image forming device 22. As shown in FIG. 13, in the final position of imaging unit 200, upstop 288 on handle frame 206 is positioned underneath a ledge 330 formed in side wall 328 of frame 320 in image forming device 22. Similarly, upstop 289 is positioned underneath a corresponding ledge on side 215 of imaging unit 200. When imaging unit 200 is removed from image forming device 22, top portions of upstops 288, 289 contact the corresponding ledges in image forming device 22 if handle frame 206 is raised upward too quickly as the user pulls on handle 228 in order to provide a controlled removal of imaging unit 200 from image forming device 22.

Accordingly, the positioning features of imaging unit 200 help control and guide imaging unit 200 during insertion into image forming device 22 and provide precise alignment of imaging unit 200 in the final installed position of imaging unit 200 in image forming device 22. The positioning features of imaging unit 200 precisely align the interface features of imaging unit 200 with corresponding interface features on toner cartridge 100 and image forming device 22 while also allowing a user to easily load and unload imaging unit 200 into and out of image forming device 22.

Although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit having a reservoir for storing toner and a rotatable developer roll positioned to transfer toner from the reservoir to the photoconductive drum; and a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device, wherein each of the front and rear contact members of the first and second alignment guides includes a roll rotatable relative to the housing, the rolls of the front and rear contact members are unobstructed to permit the rolls of the front and rear contact members to ride on top of the corresponding guide rails in the image forming device to control the vertical position of the imaging unit during insertion of the imaging unit into the image forming device.

2. The replaceable imaging unit of claim 1, further comprising a first blocking rib extending outward from the first side of the housing on the photoconductor unit and a second blocking rib extending outward from the second side of the housing on the photoconductor unit at the same height as the first blocking rib, the first and second blocking ribs are positioned at front portions of the first and second alignment guides directly rearward from the front contact members of the first and second alignment guides, top surfaces of the first and second blocking ribs are positioned higher than rotational axes of the rolls of the front contact members of the first and second alignment guides.

3. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing;

a developer unit having a reservoir for storing toner and a rotatable developer roll positioned to transfer toner from the reservoir to the photoconductive drum; and a handle frame positioned at the rear of the housing and attached to the photoconductor unit, the handle frame includes a handle exposed for user engagement to assist with insertion and removal of the imaging unit into and out of the image forming device; and a first alignment wing extending outward from the first side of the housing on the handle frame and a second alignment wing extending outward from the second side of the housing on the handle frame at the same height as the first alignment wing, the first and second alignment wings run parallel to each other along a front-to-rear dimension of the housing, each of the first and second alignment wings includes an outer side surface that is unobstructed to permit the outer side surfaces to contact corresponding guides in the image forming device during insertion of the imaging unit into the image forming device; and a first upstop extending outward from the first side of the housing on the handle frame at a rear end of the handle frame and a second upstop extending outward from the second side of the housing on the handle frame at the rear end of the handle frame at the same height as the first upstop, the first and second alignment wings lead rearward to the first and second upstops, the first and second upstops extend further outward sideways than the first and second alignment wings, a top portion of each of the first and second upstops is unobstructed to permit the top portions of the first and second upstops to contact the corresponding guides in the image forming device to limit upward travel of the handle frame during removal of the imaging unit from the image forming device.

4. The replaceable imaging unit of claim 3, wherein each of the first and second alignment wings includes a tapered front portion that inclines outward sideways as the tapered front portion extends rearward.

5. The replaceable imaging unit of claim 4, wherein each of the first and second alignment wings includes a trailing portion having a constant position in an axial dimension of the photoconductive drum, the tapered front portions of the first and second alignment wings lead rearward to the trailing portions of the first and second alignment wings.

6. The replaceable imaging unit of claim 3, wherein the photoconductor unit includes a drive coupler rotatably coupled to the photoconductive drum and exposed on the first side of the housing to engage a corresponding drive coupler in the image forming device when the imaging unit is installed in the image forming device, further comprising a lead-in guide positioned on the first side of the housing immediately in front of the drive coupler of the photoconductor unit, the lead-in guide includes an inclined contact surface that inclines outward sideways as the inclined contact surface extends rearward toward the drive coupler of the photoconductor unit, the inclined contact surface is unobstructed to permit the corresponding drive coupler in the image forming device to contact the inclined contact surface during insertion of the imaging unit into the image forming device.

7. The replaceable imaging unit of claim 3, further comprising an axial biasing surface on the first side of the housing on the photoconductor unit, the axial biasing surface includes a leading surface portion, a ramped surface portion and a trailing surface portion, the leading surface portion extends rearward from the front of the housing and leads rearward to the ramped surface portion, the ramped surface portion inclines outward sideways as the ramped surface portion extends rearward and leads rearward to the trailing surface portion, the trailing surface portion is positioned further outward sideways than the leading surface portion, the axial biasing surface is unobstructed to permit the axial biasing surface to directly receive an inward sideways biasing force from a corresponding biasing member in the image forming device to control a position of the imaging unit in the image forming device along an axial dimension of the photoconductive drum.

8. The replaceable imaging unit of claim 3, further comprising a first foot and a second foot each formed integrally with a frame of the photoconductor unit, the first foot extends downward at the bottom of the housing on the first side of the housing and the second foot extends downward at the bottom of the housing on the second side of the housing, bottom surfaces of the first and second feet are unobstructed to permit the bottom surfaces of the first and second feet to provide rotational stops to prevent the imaging unit from rotating about the rotational axis of the photoconductive drum when the imaging unit is installed in the image forming device.

9. The replaceable imaging unit of claim 3, further comprising a first alignment guide extending outward from the first side of the housing on the photoconductor unit and a second alignment guide extending outward from the second side of the housing on the photoconductor unit at the same height as the first alignment guide, the first and second alignment guides run parallel to each other along the front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device.

10. The replaceable imaging unit of claim 9, wherein each of the front and rear contact members of the first and second alignment guides includes a roll rotatable relative to the housing, the rolls of the front and rear contact members are unobstructed to permit the rolls of the front and rear contact members to ride on top of the corresponding guide rails in the image forming device to control the vertical position of the imaging unit during insertion of the imaging unit into the image forming device.

11. The replaceable imaging unit of claim 10, further comprising a first blocking rib extending outward from the first side of the housing on the photoconductor unit and a second blocking rib extending outward from the second side of the housing on the photoconductor unit at the same height as the first blocking rib, the first and second blocking ribs are positioned at front portions of the first and second alignment guides directly rearward from the front contact members of the first and second alignment guides, top surfaces of the first and second blocking ribs are positioned higher than rotational axes of the rolls of the front contact members of the first and second alignment guides.

12. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit having a reservoir for storing toner and a rotatable developer roll positioned to transfer toner from the reservoir to the photoconductive drum; and a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device, wherein the photoconductor unit includes a drive coupler rotatably coupled to the photoconductive drum and exposed on the first side of the housing to engage a corresponding drive coupler in the image forming device when the imaging unit is installed in the image forming device, further comprising a lead-in guide positioned on the first side of the housing immediately in front of the drive coupler of the photoconductor unit, the lead-in guide includes an inclined contact surface that inclines outward sideways as the inclined contact surface extends rearward toward the drive coupler of the photoconductor unit, the inclined contact surface is unobstructed to permit the corresponding drive coupler in the image forming device to contact the inclined contact surface during insertion of the imaging unit into the image forming device.

13. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit having a reservoir for storing toner and a rotatable developer roll positioned to transfer toner from the reservoir to the photoconductive drum;

a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device; and an axial biasing surface on the first side of the housing on the photoconductor unit below the first alignment guide, the axial biasing surface includes a leading surface portion, a ramped surface portion and a trailing surface portion, the leading surface portion extends rearward from the front of the housing and leads rearward to the ramped surface portion, the ramped surface portion inclines outward sideways as the ramped surface portion extends rearward and leads rearward to the trailing surface portion, the trailing surface portion is positioned further outward sideways than the leading surface portion, the axial biasing surface is unobstructed to permit the axial biasing surface to directly receive an inward sideways biasing force from a corresponding biasing member in the image forming device to control a position of the imaging unit in the image forming device along an axial dimension of the photoconductive drum.

14. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing and a developer unit having a reservoir for storing toner and a rotatable developer roll positioned to transfer toner from the reservoir to the photoconductive drum;

a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device; and a first foot and a second foot each formed integrally with a frame of the photoconductor unit, the first foot extends downward at the bottom of the housing on the first side of the housing and the second foot extends downward at the bottom of the housing on the second side of the housing, bottom surfaces of the first and second feet are unobstructed to permit the bottom surfaces of the first and second feet to provide rotational stops to prevent the imaging unit from rotating about the rotational axis of the photoconductive drum when the imaging unit is installed in the image forming device.

15. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit having a reservoir for storing toner and a rotatable developer roll positioned to transfer toner from the reservoir to the photoconductive drum; and a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device, wherein the housing includes a handle frame positioned at the rear of the housing and attached to the photoconductor unit, the handle frame includes a handle exposed for user engagement to assist with insertion and removal of the imaging unit into and out of the image forming device, further comprising a first alignment wing extending outward from the first side of the housing on the handle frame and a second alignment wing extending outward from the second side of the housing on the handle frame at the same height as the first alignment wing, the first and second alignment wings run parallel to each other along the front-to-rear dimension of the housing, each of the first and second alignment wings includes an outer side surface that is unobstructed to permit the outer side surfaces to contact corresponding guides in the image forming device during insertion of the imaging unit into the image forming device.

16. The replaceable imaging unit of claim 15, wherein each of the first and second alignment wings includes a tapered front portion that inclines outward sideways as the tapered front portion extends rearward.

17. The replaceable imaging unit of claim 16, wherein each of the first and second alignment wings includes a trailing portion having a constant position in an axial dimension of the photoconductive drum, the tapered front portions of the first and second alignment wings lead rearward to the trailing portions of the first and second alignment wings.

18. A replaceable imaging unit for use in an electrophotographic image forming device, comprising:

a housing having a top, a bottom, a front and a rear positioned between a first side and a second side of the housing, the housing includes:

a photoconductor unit positioned at the front of the housing, the photoconductor unit includes a rotatable photoconductive drum having a rotational axis that extends from the first side of the housing to the second side of the housing; and a developer unit having a reservoir for storing toner and a rotatable developer roll positioned to transfer toner from the reservoir to the photoconductive drum; and a first alignment guide extending outward from the first side of the housing on the photoconductor unit and a second alignment guide extending outward from the second side of the housing on the photoconductor unit at the same height as the first alignment guide, the first and second alignment guides run parallel to each other along a front-to-rear dimension of the housing, each of the first and second alignment guides includes a front contact member at a front end of said alignment guide and a rear contact member at a rear end of said alignment guide, the front contact members are positioned further outward sideways than the rear contact members, bottom surfaces of the front and rear contact members are unobstructed to permit the bottom surfaces of the front and rear contact members to sit on top of corresponding guide rails in the image forming device to control a vertical position of the imaging unit during insertion of the imaging unit into the image forming device, wherein the housing includes a handle frame positioned at the rear of the housing and attached to the photoconductor unit, the handle frame includes a handle exposed for user engagement to assist with insertion and removal of the imaging unit into and out of the image forming device, further comprising a first upstop extending outward from the first side of the housing on the handle frame at a rear end of the handle frame and a second upstop extending outward from the second side of the housing on the handle frame at the rear end of the handle frame at the same height as the first upstop, a top portion of each of the first and second upstops is unobstructed to permit the top portions of the first and second upstops to contact corresponding guides in the image forming device to limit upward travel of the handle frame during removal of the imaging unit from the image forming device.

* * * * *